US010247461B2

(12) United States Patent
Rohr et al.

(10) Patent No.: US 10,247,461 B2
(45) Date of Patent: Apr. 2, 2019

(54) HYBRID POWERED COOLING UNIT

(71) Applicant: SCHNEIDER ELECTRIC IT CORPORATION, West Kingston, RI (US)

(72) Inventors: Daniel J. Rohr, Wildwood, MO (US); John H. Bean, Jr., Wentzville, MO (US); Kevin M. Kemper, Lake Saint Louis, MO (US)

(73) Assignee: SCHNEIDER ELECTRIC IT CORPORATION, West Kingston, RI (US)

( * ) Notice: Subject to any disclaimer, the term of this patent is extended or adjusted under 35 U.S.C. 154(b) by 73 days.

(21) Appl. No.: 14/906,099

(22) PCT Filed: Jul. 19, 2013

(86) PCT No.: PCT/US2013/051343
§ 371 (c)(1),
(2) Date: Jan. 19, 2016

(87) PCT Pub. No.: WO2015/009323
PCT Pub. Date: Jan. 22, 2015

(65) Prior Publication Data
US 2016/0161166 A1 Jun. 9, 2016

(51) Int. Cl.
*F25B 49/02* (2006.01)
*F25B 31/00* (2006.01)

(52) U.S. Cl.
CPC ..... *F25B 49/022* (2013.01); *F25B 31/00* (2013.01); *F25B 2500/05* (2013.01)

(58) Field of Classification Search
CPC ..... F25B 49/022; F25B 31/00; F25B 2500/05
See application file for complete search history.

(56) References Cited

U.S. PATENT DOCUMENTS 2,902,205 A * 9/1959 Parker ..... B60H 1/3222 290/1 R
3,646,773 A * 3/1972 Falk ..... F25B 13/00 62/160
2001/0015070 A1* 8/2001 Hara ..... B60H 1/3208 62/133
2004/0079098 A1* 4/2004 Uno ..... B60H 1/322 62/236
2006/0053785 A1* 3/2006 Mori ..... B60K 8/00 60/520

(Continued)

FOREIGN PATENT DOCUMENTS

DE 2705869 A1 * 8/1978 ..... F02B 63/00
DE 2705869 A1 * 8/1978 ..... F02B 63/00

OTHER PUBLICATIONS

Extended European Search Report from corresponding European Application No. 13889383.9 dated Feb. 16, 2017.

(Continued)

*Primary Examiner* — Emmanuel Duke
(74) *Attorney, Agent, or Firm* — Lando & Anastasi, LLP

(57) ABSTRACT

Disclosed herein are aspects and embodiments of an air conditioning system and a method of operating the air conditioning system. In one example, an air conditioning system includes a compressor selectively operated by a first power source and a second power source.

17 Claims, 3 Drawing Sheets

(56) References Cited

U.S. PATENT DOCUMENTS

| | | | | |
|---|---|---|---|---|
| 2008/0093143 | A1* | 4/2008 | Harrison | B60H 1/3208 180/165 |
| 2010/0145629 | A1* | 6/2010 | Botich | G06Q 30/0283 702/23 |
| 2012/0125029 | A1 | 5/2012 | Moreau | |
| 2012/0130555 | A1* | 5/2012 | Jelinek | G01D 4/004 700/291 |
| 2013/0047616 | A1* | 2/2013 | Holmes | F24D 11/005 60/670 |

OTHER PUBLICATIONS

Notification of Transmittal of the International Search Report and the Written Opinion of the International Searching Authority from corresponding PCT/US2013/051343 dated Dec. 19, 2013.

* cited by examiner

HYBRID POWERED COOLING UNIT

CROSS-REFERENCE TO RELATED APPLICATIONS

This application is a U.S. National Stage Application under 35 U.S.C. § 371 of international Application No. PCT/US2013/051343, filed Jul. 19, 2013, titled HYBRID POWERED COOLING UNIT, which is hereby incorporated herein by reference in its entirety.

BACKGROUND

1. Technical Field

Aspects and embodiments disclosed herein relate to air conditioning systems for cooling buildings such as residential units, and to methods and systems for powering the condensers of such air conditioning systems.

2. Discussion of Related Art

Air cooling systems for buildings, for example, residential units, may be provided as smaller window mounted units, often having the capacity to cool only a single room or a small residence, or as larger whole building units to provide cool air to what is commonly referred to as a "central air" system for cooling multiple rooms of a building or an entire building. Some building cooling systems, for example, "swamp cooler" systems, which are most commonly used in arid areas, have few moving internal components other than a fan to draw air through a moistened mat of material. More common building cooling systems typically rely on the compression and expansion of a refrigerant with a compressor to alternatively heat and cool the refrigerant and provide a heat sink to cool air within a building. These types of cooling systems are usually associated with the term "air conditioner." A refrigeration cycle in a typical air conditioner uses a motor to drive the operation of a compressor. The compressor causes a pressure change in a refrigerant circulated between two compartments. The refrigerant is pumped through an expansion valve into an evaporator coil, located in a first compartment, where a low pressure environment within the evaporator coil causes the refrigerant to evaporate into a vapor and drop in temperature. A fan circulates air from within the building to be cooled over the evaporator coil to transfer heat from the air into the evaporated refrigerant, cooling the air, which is then directed back into the building. The refrigerant is then directed into a condenser located outside of the cooled compartment, where the refrigerant vapor is compressed and forced through a heat exchange coil, condensing the refrigerant into a liquid and increasing its temperature. An additional source of air is circulated over the heat exchange coil to remove heat from the compressed coolant and deliver it into an environment outside of the building. The refrigerant then passes back through the expansion valve into the evaporator coil where it absorbs additional heat from air in the building. Heat absorbed from the air inside the building is thus transferred outside of the building.

Residential sized air conditioning systems typically rely on electric motors to drive the compressor and circulate the refrigerant through the air conditioning system. At least one larger air conditioning system, the York Triathlon™ Natural Gas Heating and Cooling System (Johnson Controls, Inc., discontinued) included a compressor powered by an internal combustion engine.

SUMMARY

In accordance with an aspect of the present disclosure, there is provided an air conditioning system including a compressor selectively operated by a first power source and a second power source.

In some embodiments, the first power source is an electric motor and the second power source is an internal combustion engine. The internal combustion engine may be a natural gas powered internal combustion engine.

In some embodiments, the compressor is selectively operated by the electric motor and the internal combustion engine responsive to a manual selection by a user, and in some embodiments, the compressor is selectively operated by the electric motor and the internal combustion engine responsive to an output of an electronic controller.

In some embodiments, the output of the electronic controller is provided responsive to a preprogrammed selection criterion. The preprogrammed selection criterion may include one or more of time of day and relative cost of operating the compressor with the electric motor as compared to operating the compressor with the internal combustion engine.

In some embodiments, the air conditioning system further comprises a source of information regarding available rates for electricity and natural gas in electrical communication with the electronic controller.

In some embodiments, the air conditioning system further comprises a data recorder configured to record energy costs of operating the system and to provide a summary of the relative costs of operating the system with the electric motor as compared to operating the system with the internal combustion engine to a user.

In some embodiments, the air conditioning system further comprises a combustion engine clutch configured to provide selective engagement of an output shaft of the internal combustion engine with the compressor.

In some embodiments, the air conditioning system further comprises an electric motor clutch configured to provide selective engagement of an output shaft of to the electric motor with the compressor. The combustion engine clutch and electric motor clutch may be selectively operable to provide for the internal combustion engine to drive a shaft of the electric motor while not driving operation of the compressor.

In accordance with another aspect, there is provided a method of operating an air conditioning system. The method comprises selectively operating a compressor of the system with one of a first power source and a second power source.

In some embodiments, the selection of the one of the first power source and the second power source to operate the compressor is made responsive to a manual selection by a user.

In some embodiments, the selection of the one of the first power source and the second power source to operate the compressor is made responsive to an output of an electronic controller.

In some embodiments, the output of the electronic controller is provided responsive to a preprogrammed selection criterion. The preprogrammed selection criterion may include one or more of time of day and relative cost of operating the compressor with the first power source as compared to operating the compressor with the second power source.

In some embodiments, the method further comprises recording energy costs of operating the system and providing a summary of the relative costs of operating the system with the first power source as compared to operating the system with the second power source to a user.

In some embodiments, the method further comprises generating electrical power by driving the second power source with the first power source.

In some embodiments, the method further comprises one of charging a start-up battery for the first power source with the generated electrical power and driving one or more fans of the air conditioning system with the generated electrical power.

BRIEF DESCRIPTION OF DRAWINGS

The accompanying drawings are not intended to be drawn to scale. In the drawings, each identical or nearly identical component that is illustrated in various to figures is represented by a like numeral. For purposes of clarity, not every component may be labeled in every drawing. In the drawings.

DETAILED DESCRIPTION

Figure 1:
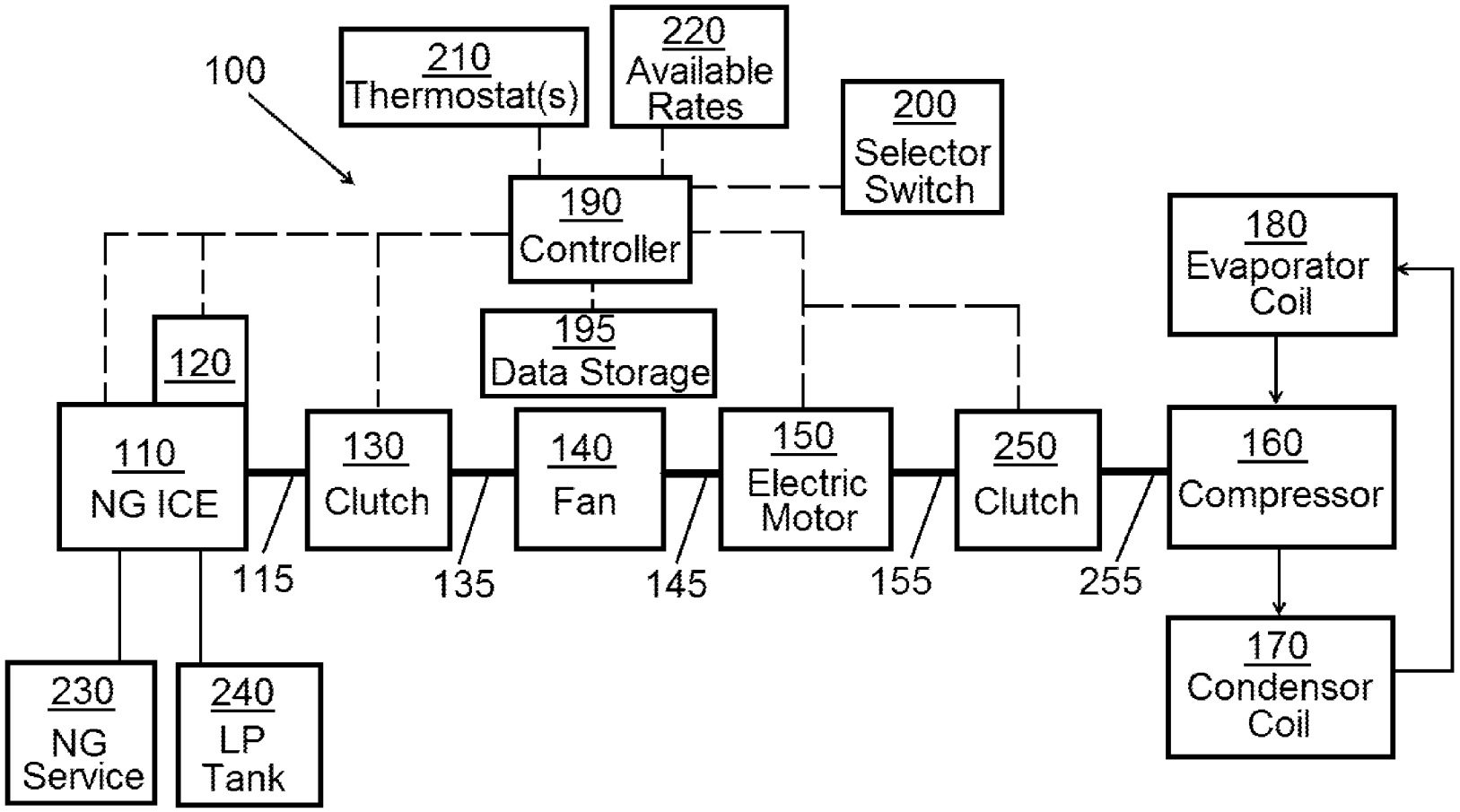
FIG. 1 is a schematic diagram of an air conditioning system in accordance with one embodiment.

Aspects and embodiments disclosed herein are directed toward an air conditioning system including a condensing unit including a compressor, condensing coil, and fan wherein the compressor may be driven by either an electric motor or a natural gas (NG) internal combustion engine (ICE) and to methods of operating same. The energy source (electric or NG) for the air conditioning system may be selected in response to one or more operating parameters or conditions. These operating parameters or conditions may in some embodiments include, for example, time of day or relative operating costs between electric and NG powered operation. For example, in some embodiments, on hot days, there may be a high load on an electrical utility grid and electrical power may be priced at a high level. Under such conditions, it may be desirable to operate the air conditioning system using NG for a power source instead of electricity. Under nighttime conditions, electrical power may be more competitively priced or may be less expensive than NG power. Thus, it may be preferable to operate the air conditioning system using electricity from the utility grid as a power source instead of NG. Further, operation of the air conditioning system with an electrical motor may produce less noise than when operating the system using an NG ICE motor, further enhancing the desirability of operating the system with electrical power during nighttime hours when residents of a building located proximate the system may be attempting to sleep.

In the United States, electrical power rates are rising while NG rates are dropping. For residential consumers, electrical rates have risen from an average retail price of about 8.6 cents per kilowatt-hour (kWh) in 2001 to an average retail price of to about 11.9 cents per kWh in 2012. (source: U.S. Energy Information Administration)

In contrast, NG prices have been dropping with the average price of NG energy in the United States being about 2.7 cents per kWh as of April, 2013, calculated based on \$US10.44 per 1,000 feet$^3$=\$US0.37 per m$^3$ (source: U.S. Energy Information Administration) and an energy content of NG of 13.5 kWh per m$^3$. Assuming an electric motor is about 78% efficient, and an NG ICE is about 35% efficient, the relative cost of operating the compressor with an electric motor as compared to a NG ICE would be about (11.9/0.78)/(2.7/0.35)=1.98. Operating an air conditioning system using a NG powered ICE instead of an electric motor would decrease the daytime operating costs, perhaps by about 50%. This reduction in operating costs may be even greater during periods at which electrical energy is provided at peak rates instead of the average rate of 11.9 cents per kWh used in the above calculation. Peak rates for electrical energy may in some instances be two times or greater than the average rate, depending upon location and utility provider. The reduction in operating cost may vary in different regions due to the difference in electricity and NG rates in different locales.

Aspects and embodiments disclosed herein address a number of problems. Among these are that rising electrical power rates are beginning to make cooling a house a luxury for many people. This problem is compounded by the fact that peak electric rates are often set when cooling demand is highest. Stresses on the electric grid are becoming more severe every year; overloaded transmission lines and problems with building base load plants to support increased demand are increasing the chances for rolling blackouts or brownouts during times of peak electricity demand. In contrast with electrical power, natural gas is not being optimally consumed; there is an oversupply of natural gas in the United States. Aspects and embodiments disclosed herein which provide for the use of natural gas to power residential air conditioner systems instead of electrical grid power will provide for a reduction in the daytime loading of the electric grid. Advantages of various aspects and embodiments disclosed herein include providing greater access to different sources of energy for powering an air conditioning system and avoidance of energy conversions, for example, providing electricity produced by a NG genset to an electric to motor to power the compressor of an air conditioning system versus powering the compressor directly with a NG ICE.

Aspects and embodiments disclosed herein provide for smart air conditioning system energy management. In some embodiments, an air conditioning system may be provided with a manually selectable energy source for providing motive power to components of the air conditioning system such as the compressor and/or fan(s). In other embodiments, the selection of energy source for providing motive power to the air conditioning system may be automatically determined by a programmable electronic controller. The electronic controller may effect a change in energy source for the air conditioning system based on a preprogrammed set of criteria. Criteria which may influence a decision by the electronic controller as to which energy source should be used to provide power to the air conditioning system (or by a user when a manually operated switch is used to select an energy source for the air conditioner) may include any one or more of time of day, relative cost of power from the different energy sources (which may be correlated with the time of day), desirable noise level (which may be correlated with the time of day), redundancy during outages (for example, providing for a genset to power the fan(s) of the air conditioning system, while the compressor is powered by the NG ICE if electric power is unavailable), buffering against energy cost spikes (electric or NG), redundancy during motor failure (for example, to utilize the electric motor if the NG ICE fails, and to utilize the NG ICE if the electric motor fails), and the cooling load desired to be supplied by the air conditioning system. For example, low cooling load conditions may favor the electric motor driving the compressor if the ICE was not already running This may be preferred to prevent excessive cycling of the engine for short run duration during low cooling loads.

In some embodiments a NG ICE may be selectively utilized to power an air conditioning system to leverage the cost savings for energy. In some embodiments, the NG ICE may be deactivated when there is insufficient demand for energy to justify running the NG ICE. The NG ICE may be started or stopped based on the energy demand of the air conditioning system and may be supplemented or replaced by an electric motor to power the air conditioning system when it would be beneficial to power the air conditioning system with the electric motor.

In some embodiments, as illustrated in FIG. 1, an air conditioning system 100 may include a NG ICE 110 and associated starter motor 120, for example, an electric starter motor, a clutch 130, for example, an electric clutch, a fan 140, for example, a fan configured and arranged to provide a flow of air to cool a condenser coil 170 of the system 100, an electric motor 150, a compressor 160. The compressor 160 is configured to circulate refrigerant through a cooling loop including the condenser coil 170 and an evaporator coil 180, a controller 190. The system 100 also may include a manually operable selector switch 200. In some embodiments, the selector switch 200 may provide a signal to the controller 190. In other embodiments, the selector switch 200 may provide a signal directly to the NG ICE 110 and electric motor 150 and/or associated clutches (discussed below) to select which power source should be used to power the compressor. Alternatively, the controller 190 may be programmed to select which power source should be used to power the compressor in the absence of a manually operated selector switch. The controller 190 may be an electronic controller including inputs to receive signals from one or more thermostats 210 from one or more cooling zones and may make decisions as to when to operate the air conditioning system 100 responsive to signals provided by the one or more thermostats 210. The controller 190 may also be provided with information from a source of information 220 regarding available rates for electricity and natural gas. The source of information 220 may include, for example, a user interface of the controller 190 through which a user may enter information regarding the available rates, or in other embodiments, may include an electronic system, for example, an internet connected device, capable of communicating with an electric utility, NG supplier, or other source of information regarding electric and/or NG supply rates to determine the available rates for electricity and/or NG. The controller 190 may further include an internal clock used to determine the time of day which the controller may use as an input to determine whether to power the compressor 160 with the NG ICE 110 or the electric motor 150. The controller 190 may communicate with any or all of the NG ICE 110, starter motor 120, clutch 130, and electric motor 150 to activate or deactivate the NG ICE 110 or electric motor 150 to engage the to compressor 160.

In some embodiments, the controller 190 includes a general purpose processor, for example, an Intel® CORE™ processor and associated input and output circuitry. In other embodiments, the controller 190 may include a programmable logic controller (PLC). Embodiments disclosed herein are not limited to any particular form of the controller 190.

In some embodiments, the controller 190 may include or be in communication with a data recorder 195 configured to record energy costs of operating the system 100 and to provide a summary of the relative costs of operating the system with the electric motor 150 as compared to operating the system with the NG ICE 110 to a user. This information may be used by the user to perform analysis of the energy costs of the system 100 and adjust one or more operating parameters, for example, a time of day at which the electric motor 150 should be used instead of the NG ICE 110 (or vice-versa) to power the compressor to reduce the overall energy cost of the system.

In some embodiments, the NG ICE 110 or electric motor 150 may also provide power to a fan for moving air across the evaporator coil (an evaporator coil fan) to absorb heat from inside of the building associated with the air conditioning system. In other embodiments, both the condenser coil fan 140 and the evaporator coil fan may be powered by electric motors distinct from the electric motor 150.

The NG ICE 110 may be connected to a source of NG 230 for a building associated with the air conditioning system 100, or to a dedicated NG line. In some embodiments, the NG ICE 110 may be capable of running on propane as well as NG and the source of NG 230 may be supplemented by or replaced with a source of propane, for example, a liquid propane (LP) tank 240.

Figure 2:
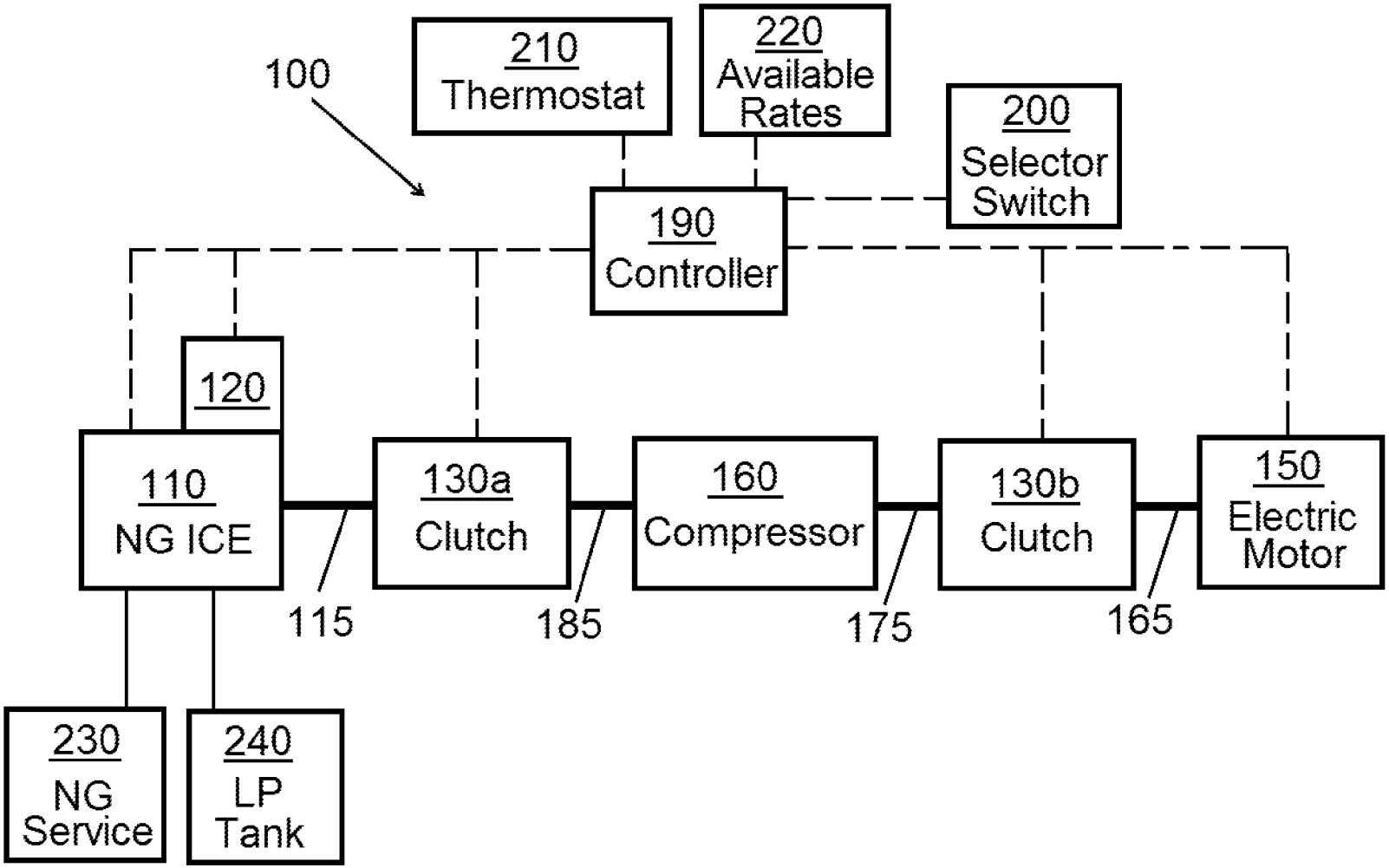
FIG. 2 is a schematic diagram of an air conditioning system in accordance with another embodiment.

The NG ICE 110, clutch 130, fan 140, electric motor 150, and compressor 160 may be interconnected through respective shafts 115, 135, 145, and 155. In some embodiments, the electric motor 150 is always coupled to a shaft of the compressor 160. In these embodiments, when the NG ICE 110 is used to power the compressor 160, the NG ICE 110 will also turn the shaft of the electric motor 150. In other embodiments, for example, as illustrated in FIG. 2, each of the NG ICE 110 and the electric motor 150 are coupled to the compressor 160 through separate clutches 130*a*, 130*b* in communication with the controller 190 and associated shafts 115, 165, 175, 185.

Figure 3:
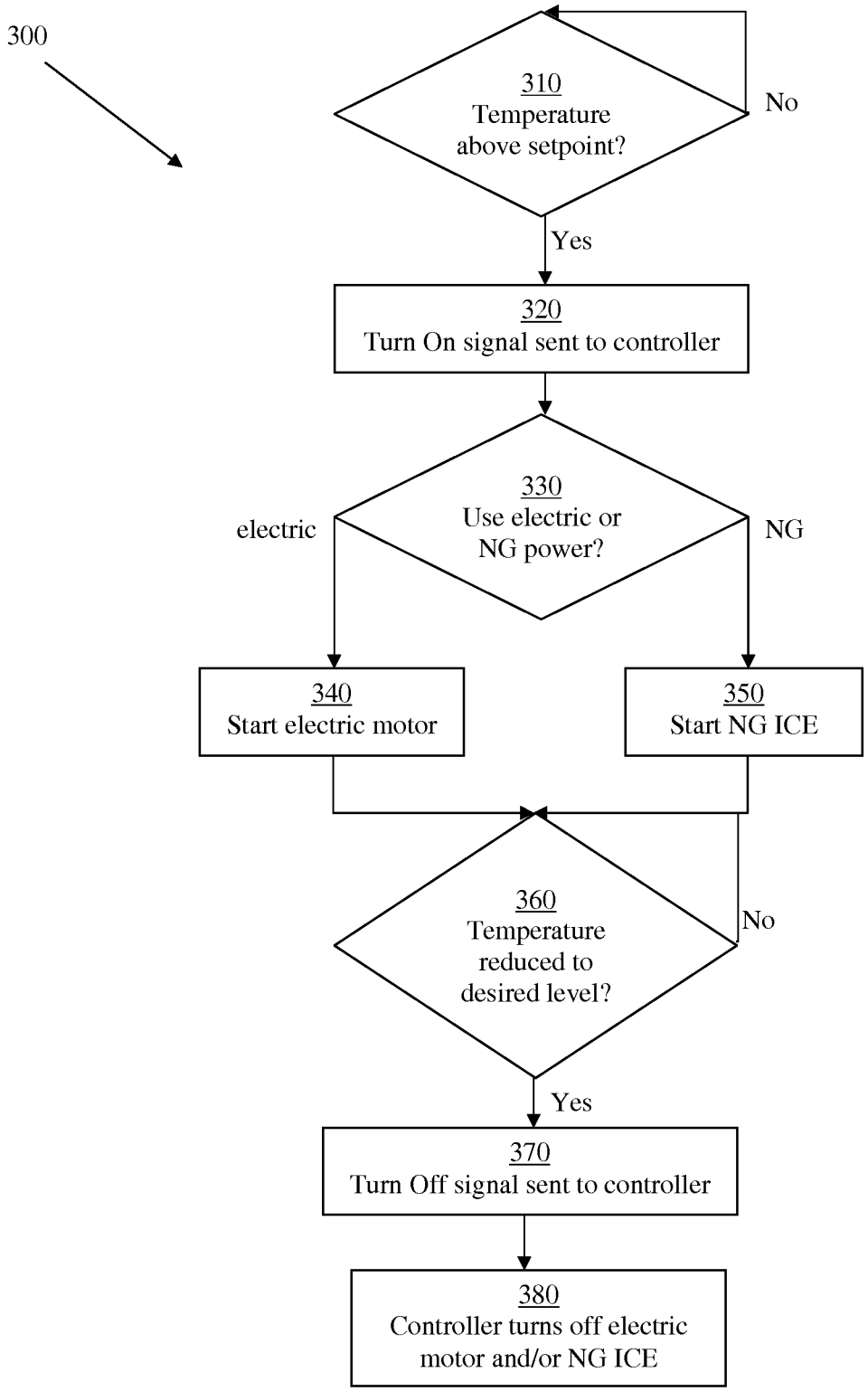
FIG. 3 is a flowchart of a method in accordance with an embodiment.

An embodiment of a method of operating the air conditioning system 100 is illustrated in the flowchart 300 of FIG. 3. In operation, when the thermostat 210, or at least one of the thermostats 210 when the air conditioning system is utilized to cool multiple zones of a building, detects that the temperature of the building or zone of the building has reached a set point at which a user desires the air conditioning system 100 to begin operation (act 310), the thermostat 210 sends a "turn on" signal to the controller 190 of the air conditioning system 100 (act 320). Responsive to the receipt of the "turn on" signal, the controller 190 will make a decision as to which power source should be utilized to power the air conditioning system 100 (act 330). The controller will then either turn on the electric motor 150 to begin powering the compressor 160 of the air conditioning system 100 (act 340) or it will energize the starter motor 120 of the NG ICE 110, for example, with electricity from the electrical utility grid or from a starter battery, to start the engine (act 350). Once the NG ICE 110 is running, the starter 120 is de-energized and the NG ICE 110 powers the compressor 160 of the air conditioning system 100. In some embodiments, the NG ICE 110 may be provided with a manual starter, for example, a ripcord which is pulled to start the NG ICE 110. The controller 190 may provide a signal to a user to operate the ripcord to start the NG ICE 110 when the controller determines the NG ICE 110 should be started. In some embodiments, the controller 190 will direct the electric motor 150 to power the compressor 160 until the user has started the NG ICE 110.

The selected power source (the electric motor 150 or the NG ICE 110) will continue to run until the thermostat 210 indicates that the temperature of the building associated with the air conditioning system 100, or a zone of the building cooled by the air conditioning system 100, has dropped to a desired level (acts 360, 370). Responsive to a signal from the thermostat 210 that the desired temperature has been reached, the controller 190 will either turn the electric motor off or it will shut the NG ICE 110 down, for example, by removal of ignition power (act 380). The air to conditioning system may be provided with ducting as known in the art to selectively direct cooled air into various zones of a building. The controller 190 may continue to operate the air conditioning system until thermostats 210 in each zone of the building to be cooled provide signals that the desired temperature(s) in each of the zones has been achieved.

In some embodiments when operating under power from the NG ICE 110 to power the compressor 160, the system 100 may utilize the electric motor 150 as a generator. The NG ICE 110 may provide power to turn the shaft of the electric motor 150 and generate electricity. The electricity generated by the electric motor 150 may be utilized to, for example, charge a starter battery for the NG ICE 110, to run one or both of the evaporator coil fan and the condenser coil fan, to supplement electrical grid power provided to a building associated with the air conditioning system 100, or to provide power to sell back to an electric power supplier. In further embodiments, the NG ICE 110 and associated clutches including, for example, an optional additional clutch 250 provided between shaft 155 and shaft 255 between the electric motor 150 and compressor 160 of FIG. 1, may be configured to turn the shaft of the electric motor 150 and generate electricity in the absence of powering the compressor. The air conditioning system 100 may thus operate as a genset to provide electrical power to a building associated with the system, for example, during periods of unavailability of electrical grid power.

With reference to the system illustrated in FIG. 1, during operation, when the controller determines that the air conditioning system should be activated, the controller makes a determination as to whether the system should be powered by the NG ICE 110 or the electric motor 150. This determination may be made based on factors such as the setting of the selector switch 200, when present, the time of day, the relative cost of electric power versus NG power, the availability of electric or NG power and/or other factors discussed previously herein. If the controller 190 determines that the compressor 160 should be powered by the NG ICE 110, it sends a signal to the starter 120 of the NG ICE and starts the NG ICE 110. The controller 190 also sends a signal to the clutch 130 and the clutch 250, when present, to engage shafts 115 and 135 and shafts 155 and 255, respectively. Motive power is then to provided through the shafts 115, 135, 145, 155, and 255 to the compressor 160 from the NG ICE 110. The electric motor 150 is also driven by the NG ICE 110 and may be utilized to provide power for various uses as discussed above, for example, to power the fans of the air conditioning system 100, recharge a starter battery of the NG ICE 110, when present, or to provide power to other systems as desired. It should be appreciated that in some embodiments, the fan 140 and/or clutch 250 and associated shafts may be omitted from the embodiment of FIG. 1.

In the embodiment of FIG. 2, when the controller 190 has made a determination that the air conditioning system 100 should be operated, the controller makes a determination as to whether the system should be powered by the NG ICE 110 or the electric motor 150. If the controller 190 determines that the compressor 160 should be powered by the NG ICE 110, it sends a signal to the starter 120 of the NG ICE and starts the NG ICE 110. The controller 190 also sends a signal to the clutch 130*a* to provide engagement between shafts 115 and 185. The controller 190 sends an additional signal to clutch 130*b* to disengage so that the electric motor 150 is not turned by the NG ICE 110. Conversely, if the controller 190 determines that the compressor 160 should be powered by the electric motor 150, it sends a signal to the electric motor 150 to start and also sends a signal to the clutch 130*b* to provide engagement between shafts 165 and 175. The controller 190 sends an additional signal to clutch 130*b* to disengage so that the electric motor 150 does not drive a shaft of the NG ICE 110. In further embodiments, where the cooling load of the air condition system requires more power to be provided to drive the operation of the compressor 160 than could be provided by either the NG ICE 110 or the electric motor 150 alone, the controller may provide a signal to both clutches 130*a* and 130*b* to engage so that the compressor 160 may be powered by both the NG ICE 110 and the electric motor 150.

Aspects disclosed herein in accordance with the present embodiments, are not limited in their application to the details of construction and the arrangement of components set forth in the following description or illustrated in the drawings. These aspects are capable of assuming other embodiments and of being practiced or of being carried out in various ways. Examples of specific implementations are provided to herein for illustrative purposes only and are not intended to be limiting. In particular, acts, elements and features discussed in connection with any one or more embodiments are not intended to be excluded from a similar role in any other embodiments.

Having thus described several aspects of at least one embodiment, it is to be appreciated various alterations, modifications, and improvements will readily occur to those skilled in the art. Such alterations, modifications, and improvements are intended to be part of this disclosure, and are intended to be within the spirit and scope of the disclosure. Accordingly, the foregoing description and drawings are by way of example only.

The invention claimed is:

1. An air conditioning system of a building, the air conditioning system comprising:

a first power source comprising an electric motor;

a second power source comprising a natural gas powered internal combustion engine;

an electronic controller; and a compressor disposed between the electric motor and the internal combustion engine selectively operated by the electric motor and the natural gas powered internal combustion engine responsive to an output of the electronic controller provided responsive to a preprogrammed selection criterion including one or more of time of day and relative cost of operating the compressor with the electric motor as compared to operating the compressor with the internal combustion engine, the air conditioning system having an operating mode in which an electric motor clutch providing selective engagement of an output shaft of the electric motor with the compressor is disengaged and the compressor is operated by the natural gas powered internal combustion engine through an output shaft directly connecting the natural gas powered internal combustion engine to a combustion engine clutch and a second shaft directly connecting the combustion engine clutch to the compressor, the electronic controller being configured to provide a signal to both the electric motor clutch and the combustion engine clutch to engage so the compressor is powered by both the internal combustion engine and the electric motor responsive to a cooling load of the air conditioning system requiring more power to be provided to drive operation of the compressor than could be provided by either the internal combustion engine or the electric motor alone.

2. The system of claim 1, wherein the compressor is additionally selectively operated by the electric motor and the internal combustion engine responsive to a manual selection by a user.

3. The system of claim 1, further comprising a source of information regarding available rates for electricity and natural gas in electrical communication with the electronic controller.

4. The system of claim 1, further comprising a data recorder configured to record energy costs of operating the system and to provide a summary of the relative costs of operating the system with the electric motor as compared to operating the system with the internal combustion engine to a user.

5. The system of claim 1, wherein the combustion engine clutch is configured to provide selective engagement of the output shaft of the internal combustion engine with the compressor.

6. The system of claim 5, wherein the combustion engine clutch and electric motor clutch are selectively operable to provide for the internal combustion engine to drive a shaft of the electric motor while not driving operation of the compressor.

7. The system of claim 1, wherein cooling load desired to be supplied by the air conditioning system influences a decision by the electronic controller as to which power source should be used to provide power to the air conditioning system.

8. The system of claim 1, wherein the internal combustion engine is capable of running on propane as well as natural gas.

9. The system of claim 1, wherein when the internal combustion engine is used to power the compressor, the internal combustion engine will also turn a shaft of the electric motor.

10. The system of claim 1, wherein the electric motor and electric motor clutch are disposed on an opposite side of the compressor from the natural gas powered internal combustion engine and the combustion engine clutch.

11. A method of operating an air conditioning system of a building, the method comprising:

selectively operating a compressor of the system with one of a first power source and a second power source, the first power source being an electric motor and the second power source being a natural gas powered internal combustion engine, a selection of the one of the first power source and the second power source to operate the compressor being made responsive to an output of an electronic controller provided responsive to a preprogrammed selection criterion including one or more of time of day and relative cost of operating the compressor with the first power source as compared to operating the compressor with the second power source;

selectively operating the air conditioning system in an operating mode in which an electric motor clutch providing selective engagement of an output shaft of the electric motor with the compressor is disengaged and the compressor is operated by the natural gas powered internal combustion engine through an output shaft directly connecting the natural gas powered internal combustion engine to a combustion engine clutch and a second shaft directly connecting the combustion engine clutch to the compressor; and responsive to a cooling load of the air conditioning system requiring more power to be provided to drive operation of the compressor than could be provided by either the internal combustion engine or the electric motor alone, the electronic controller providing a signal to both the electric motor clutch and the combustion engine clutch to engage so the compressor is powered by both the internal combustion engine and the electric motor.

12. The method of claim 11, wherein the selection of the one of the first power source and the second power source to operate the compressor is further made responsive to a manual selection by a user.

13. The method of claim 11, further comprising recording energy costs of operating the system and providing a summary of the relative costs of operating the system with the first power source as compared to operating the system with the second power source to a user.

14. The method of claim 11, further comprising generating electrical power by driving the second power source with the first power source.

15. The method of claim 14, further comprising one of charging a start-up battery for the first power source with the generated electrical power and driving one or more fans of the air conditioning system with the generated electrical power.

16. The method of claim 11, further comprising one of supplementing electrical grid power provided to the building and providing power to sell back to an electric power supplier with electrical power generated by the electric motor.

17. The method of claim 11, wherein selectively operating the compressor of the system with one of the first power source and the second power source comprises one of engaging the output shaft of the electric motor with the compressor with the electric motor clutch and engaging an output shaft of the natural gas powered internal combustion engine with the compressor with the combustion engine clutch, the electric motor and electric motor clutch being disposed on an opposite side of the compressor from the natural gas powered internal combustion engine and the combustion engine clutch.

* * * * *